US007766320B2

(12) United States Patent
Baena, Jr. et al.

(10) Patent No.: US 7,766,320 B2
(45) Date of Patent: Aug. 3, 2010

(54) MEDIA HANDLING SYSTEM FOR MAINTAINING STACK TOP WITHIN GIVEN RANGE OF PICK POSITIONS DURING FEEDING SHEETS FROM STACK TOP

(75) Inventors: Douglas Andagan Baena, Jr., Dumaguete (PH); Kim Limpahan Balahan, Dumaguete (PH); Stacey Edward Balch, Versailles, KY (US); Daniel Paul Cahill, Verona, KY (US); William Paul Cook, Lexington, KY (US); Robert Ryan Fresnoza Cruz, Mandaue (PH); Irvin Langit Libres, Cebu (PH); Jake Tia Pia, Dumaguete (PH); Jason Lee Rowe, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 12/192,556

(22) Filed: Aug. 15, 2008

(65) Prior Publication Data

US 2010/0038844 A1 Feb. 18, 2010

(51) Int. Cl.
*B65H 1/08* (2006.01)

(52) U.S. Cl. ..... 271/147; 187/262; 248/330.1

(58) Field of Classification Search ..... 271/152, 271/153, 154, 157, 147, 213, 214, 215, 217; 187/261, 262, 414; 248/329, 330.1
See application file for complete search history.

(56) References Cited

U.S. PATENT DOCUMENTS 4,718,658 A * 1/1988 Hirose et al. ..... 271/258.04

FOREIGN PATENT DOCUMENTS

DE 4105901 A1 * 8/1992

* cited by examiner

*Primary Examiner*—Gene Crawford
*Assistant Examiner*—Gerald W McClain
(74) *Attorney, Agent, or Firm*—John Victor Pezdek

(57) ABSTRACT

A media handling system includes a platform, a bin supporting the platform below and for undergoing movement toward and away from a sheet feeding position, a first motion transmitting assembly coupled between the platform and bin and tailored to counterbalance the weight of the platform and any stack such that as the weight decreases the platform is lifted toward the sheet feeding position to maintain the stack top below a lower limit position thereof, a control mechanism to sense the position of the stack top relative to a given range between the lower limit position to an upper home position, and a second motion transmitting assembly drivingly coupled to the platform via the first motion transmitting assembly and responsive to the control mechanism sensing to cause the first motion transmitting assembly to further lift the platform to and maintain the stack top position within the given range.

2 Claims, 8 Drawing Sheets

MEDIA HANDLING SYSTEM FOR MAINTAINING STACK TOP WITHIN GIVEN RANGE OF PICK POSITIONS DURING FEEDING SHEETS FROM STACK TOP

CROSS REFERENCE TO RELATED APPLICATION

This patent application is related to co-pending U.S. patent application Ser. No. 12/192,592 entitled "Media Handling System For Lowering And Raising Stack Platform Responsive To Moving Bin Between External And Internal Positions", assigned to the assignee of the present invention, and filed concurrently with the subject application.

BACKGROUND

1. Field of the Invention

The present invention relates generally to an image forming machine and, more particularly, to a media handling system for maintaining a top of a media stack within a given range of pick positions during feeding of sheets one at a time from the stack top.

2. Description of the Related Art

To feed a large amount of media sheets from a media handling system to an image forming machine without interruption, there is a first operational requirement to maintain the top of the large stack of media sheets, for instance, a stack of greater than 500 sheets, within a given range of pick positions in which a pick mechanism supported on the frame of the machine operates. This will enable a feed roll of the pick mechanism to reach and individually pick the top sheet from the stack and feed it to the image forming machine or to an intermediate module that feeds the picked sheet to the machine. To accommodate this first operational requirement in the media handling system a platform typically is provided in a movable bin. The platform is mounted to the bin so as to undergo vertical movement relative to the bin and toward and away from the pick mechanism located above the bin. Also, there is a second operational requirement that the bin itself be mounted to the frame of the machine to undergo horizontal sliding movement out of and into the machine between a reload position located externally of the frame and the sheet pick position located internally of the frame in order to periodically replenish the supply of media sheets stacked on the platform in the bin. Further, there is a third operational requirement that the components of the media handling system accommodate a range of different media types and weights.

It can easily be realized that the first two operational requirements could come into conflict when the bin needs to be moved from the internal sheet pick position to the external sheet reload position. The top of the stack on the platform or the platform itself when disposed within the given range of pick positions in which the pick mechanism operates may be close enough to cause interference with components of the pick mechanism should the bin be moved away from the frame of the machine without first relocating the platform downward away from the pick mechanism. Thus, there is a need to ensure that the platform will be maintained within a desired range of elevations or levels to keep the top of the stack within the given range of pick positions that the pick mechanism operates in while at the same time ensure that the platform will be automatically lowered to remove the top of the stack or platform below the range of pick positions wherever the bin is moved to the external reload position away from the pick mechanism of the machine. In addition, it can easily be realized that this need must be resolved in a way that allows the system to satisfy the third operational requirement, the applicability of its components to an acceptable range of different media types and weights.

A resolution of this need could readily be found if there were only modest limitations on the cost of mechanisms that could be used to fulfill all of these operational requirements. However, given the competitive market environment that exists in the field of image forming machines, rather stringent cost limitations continue to be imposed on product innovations. Feasible solutions are only those that add minimal cost to these machines while still accommodating a range of different media types and weights. Some prior art approaches are applicable only to machines that are dedicated to a single or very limited range of media types and weights. Other prior art approaches require the use of high-capacity motors with built-in power supplies that are too high in cost to implement and so are not considered to offer feasible solutions that meet these operational requirements in the current competitive environment.

Thus, there is still a need for an innovation that will resolve the potential conflict between the aforementioned operational requirements under the restrictive cost limitations imposed on product innovations.

SUMMARY OF THE INVENTION

The present invention and the invention of the above cross-referenced patent application meet this need by providing innovations that resolve in a cost-effective manner any potential conflict between maintaining the top of the stack within a given range of operating positions for performance of sheet feeding, lowering the top of the stack below such range concurrently as the bin supporting the platform is moved to an external reload position, and retaining applicability of the system to an acceptable range of media types and weights. The innovations underlying the present invention and the invention of the cross-referenced patent application involve the employment of relatively low-cost mechanical components and a low-cost low-torque drive motor in motion transmitting assemblies and a plurality of relatively low-cost sensor components, that do not require the addition of high-capacity motors nor built-in power supplies, to assist them in periodically lifting the large stack of media sheets to maintain the top of the stack within the given range of operating positions for performance of sheet feeding, in periodically lowering the platform within the bin to avoid interference between the stack top or platform and other components when the bin is moved from the internal operating or feeding position to the external reloading position, in resisting downward force on the stack top during performance of sheet feeding, and in accommodating different media types and weights within a given acceptable range.

Accordingly, in an aspect of the present invention, a media handling system for an image forming machine includes a stationary frame, a sheet feeding mechanism operable to feed sheets when the sheets are located within a given range extending from a lower limit position to an upper home position, a platform for supporting a stack of media sheets thereon, a bin supporting the platform below and aligned with the sheet feeding mechanism and for undergoing movement relative to the bin toward and away from the sheet feeding mechanism, a first motion transmitting assembly coupled between the platform and bin and being tailored to counterbalance the weight of the platform and of any stack thereon such that as the weight decreases the first motion transmitting assembly lifts the platform toward the sheet feeding mechanism so as to maintain a top of the stack at a position below and closely adjacent to the lower limit position, a control mechanism supported on the stationary frame and adapted to perform sensing of the position of a top of a stack relative to the given range extending from the lower limit position to the upper home position, and a second motion transmitting assembly having some components supported on the bin and another component supported on the frame such that the components are drivingly coupled to the platform via the first motion transmitting assembly and responsive to the sensing by the control mechanism to cause the first motion transmitting assembly to further lift the platform to, and thereby maintain the position of the top of the stack on the platform within, the given range extending from the lower limit position to the upper home position.

BRIEF DESCRIPTION OF THE DRAWINGS

Figure 1:
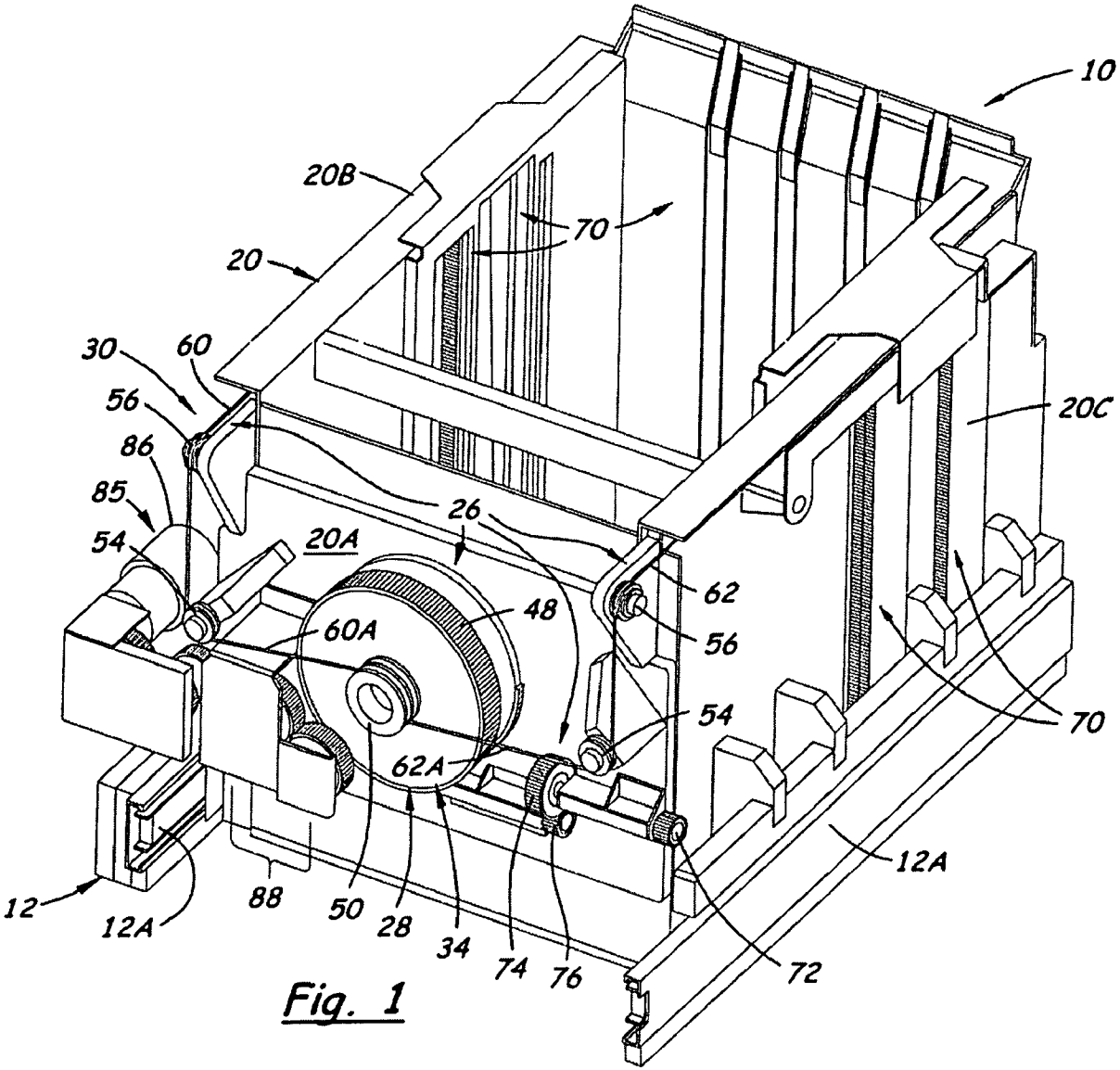

Having thus described the invention in general terms, reference will now be made to the accompanying drawings, which are not necessarily drawn to scale, and wherein:

FIG. 1 is a schematic representation of a media handling system for raising a platform thereof with reference to a sheet feeding mechanism (not shown) in accordance with the present invention and for lowering and raising the platform relative to a bin of the system in response to sliding the bin between external and internal positions in accordance with the invention of the cross-reference patent application.

Figure 2:
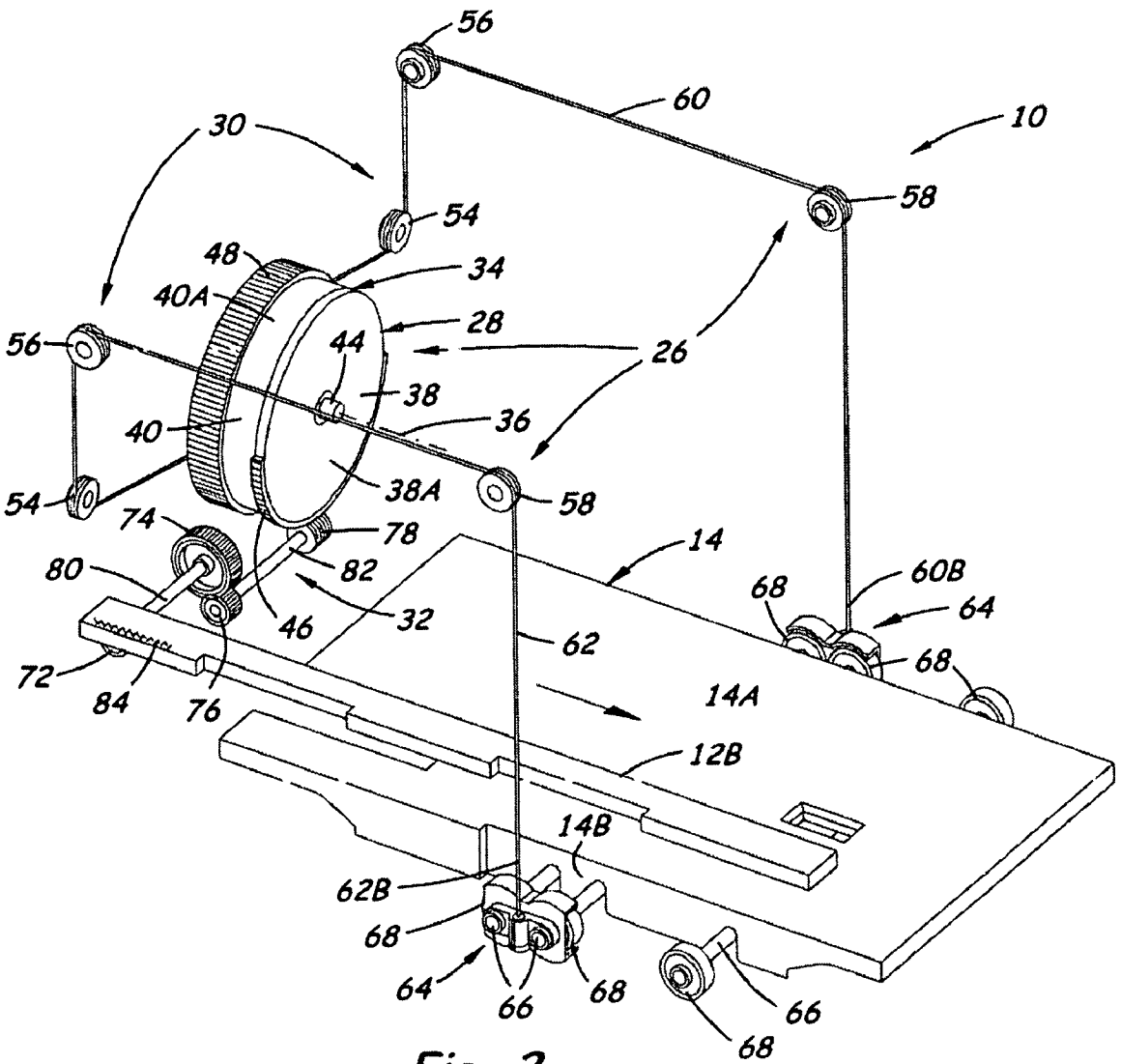

FIG. 2 is a schematic representation of a motion transmitting assembly of the media handling system, with the bin omitted, as employed with the platform and a low torque motor (not shown) and its associated gears (not shown) in accordance with the present invention and as employed with the movable bin in accordance with the invention of the cross-referenced patent application.

Figure 3:
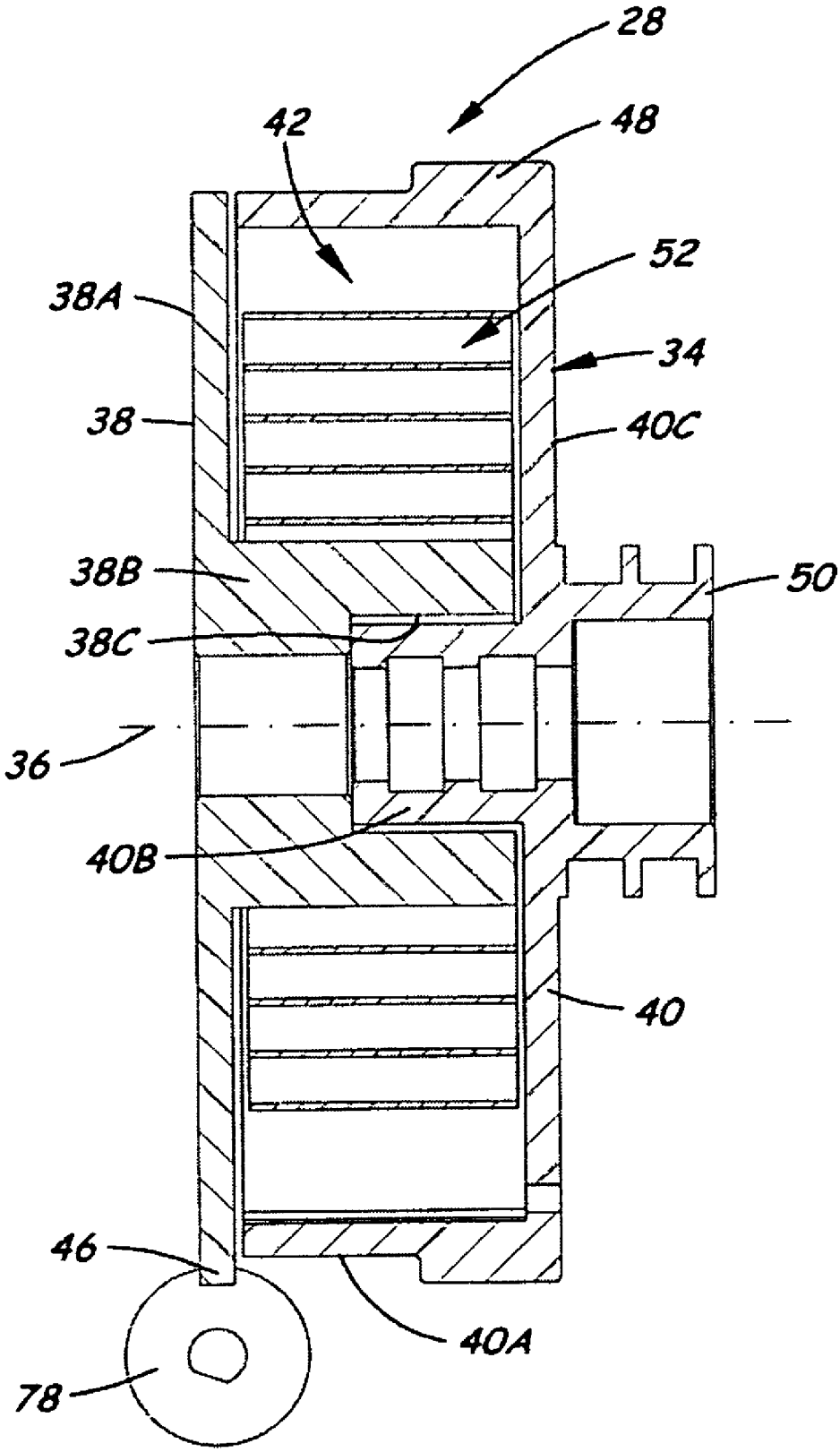

FIG. 3 is an enlarged vertical sectional view of a spring mechanism of the motion transmitting assembly of FIGS. 1 and 2 with the spring mechanism being shown alone.

Figure 4:
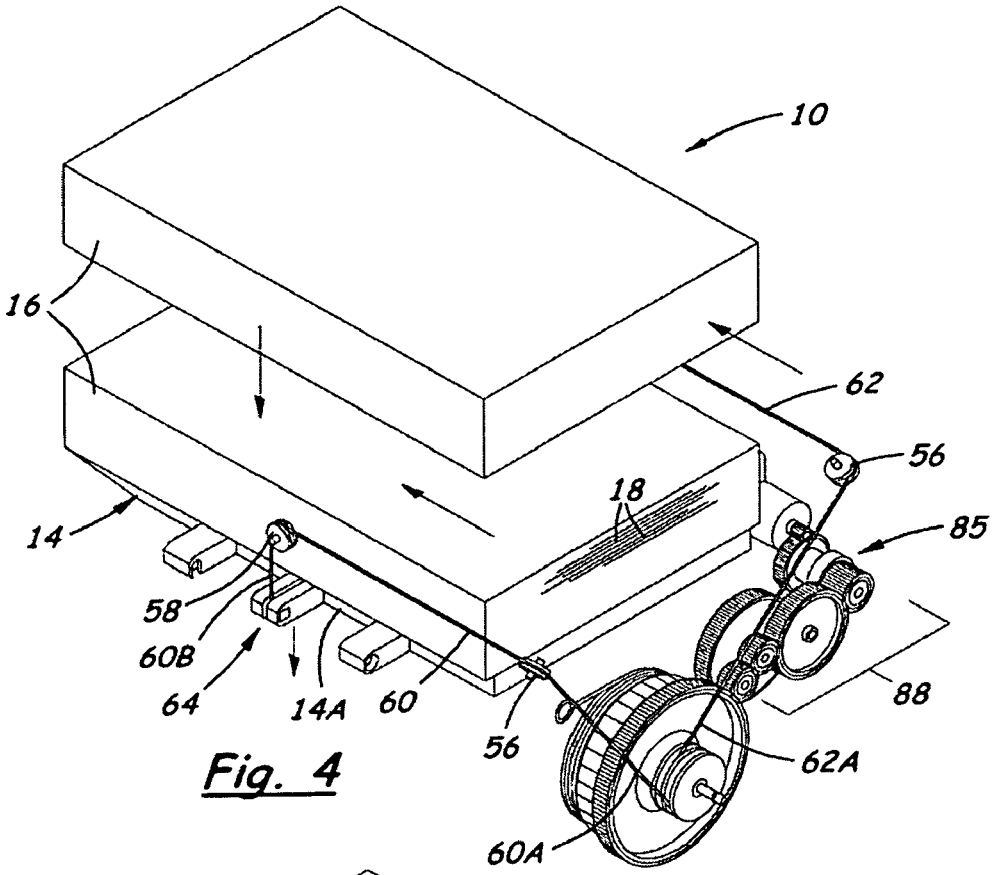

FIG. 4 is a schematic representation of the spring mechanism and rest of the motion transmitting assembly as employed with the platform and when uncoupled from the low torque motor (not shown) in accordance with the present invention.

Figure 5:
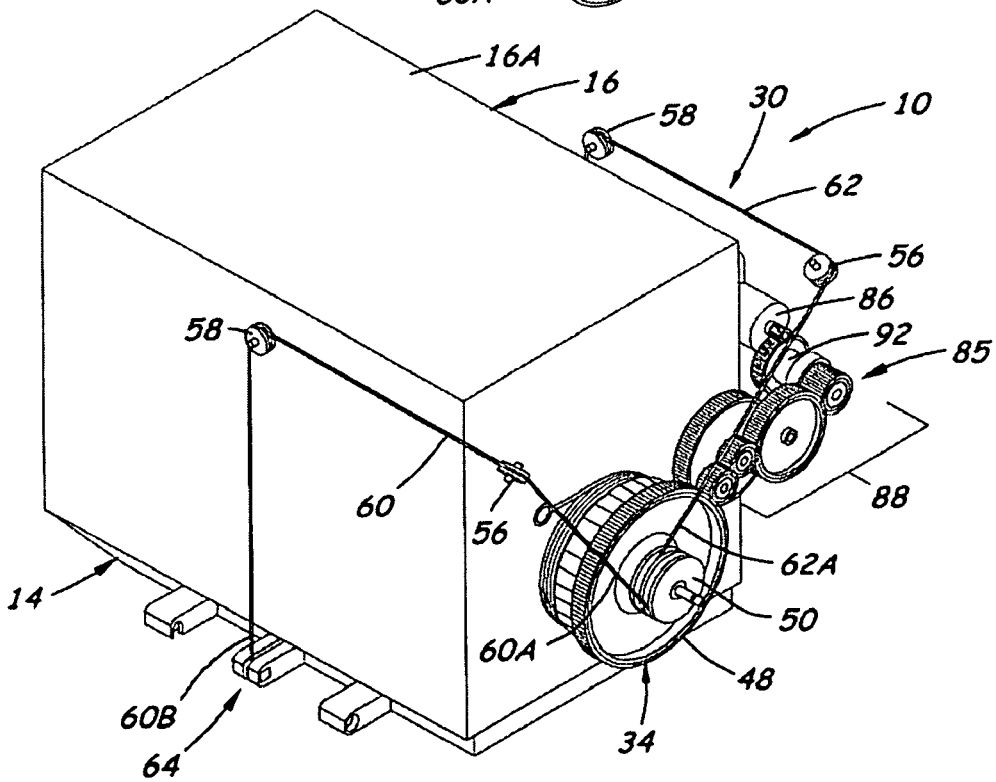

FIG. 5 is a schematic representation of the spring mechanism and rest of the motion transmitting assembly as employed with the platform and when coupled with the low torque motor in accordance with the present invention.

Figure 6:
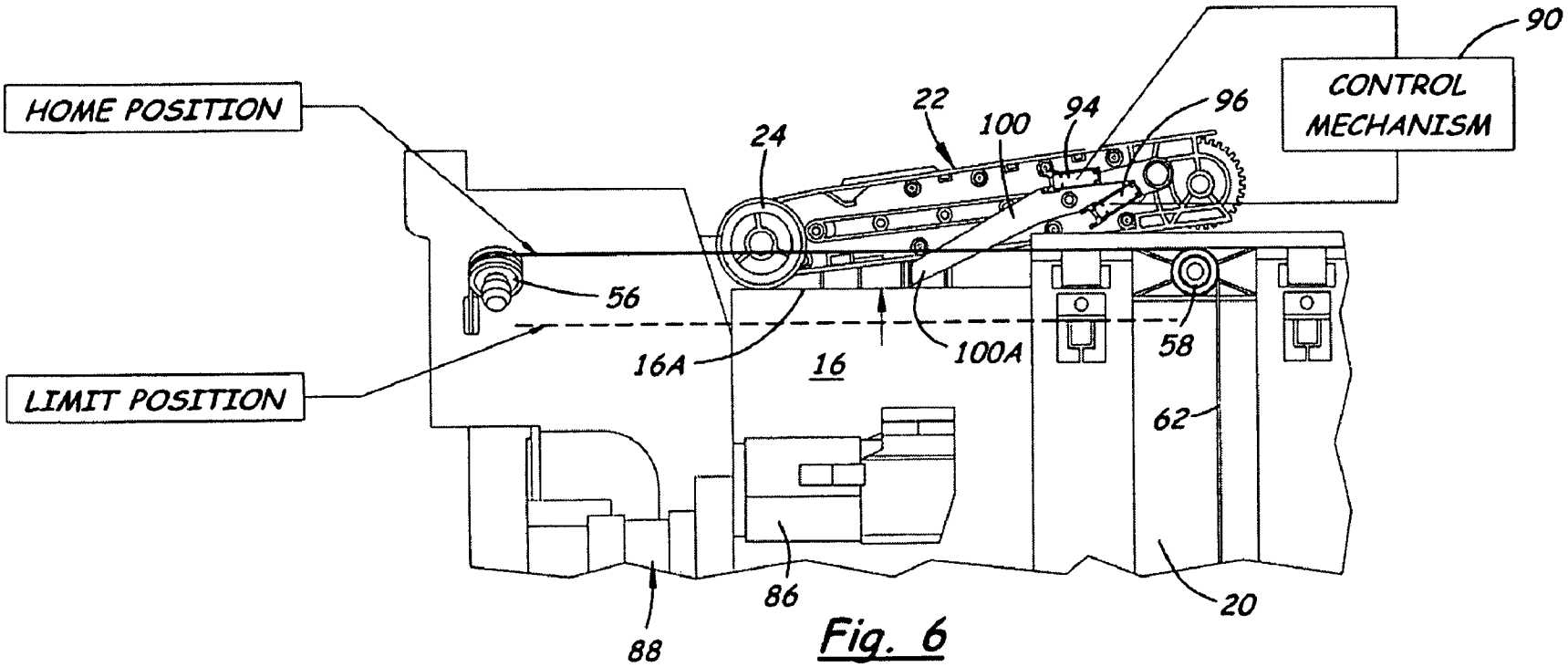

FIG. 6 is a schematic representation of the media stack in the bin of the media handling system in relation to the pick mechanism and sensors showing the top of the stack within a given range of upper home and lower limit operating positions of the pick mechanism.

Figure 7:
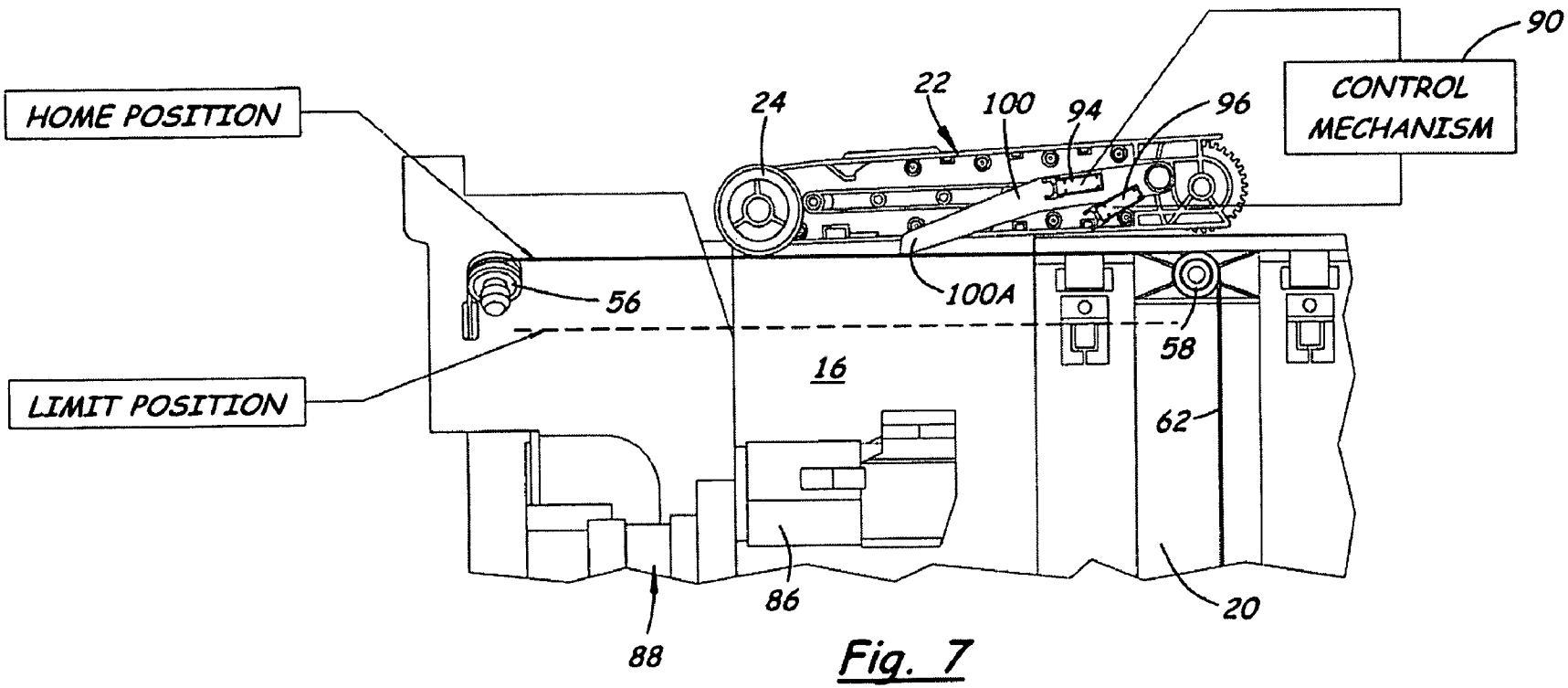

FIG. 7 is a schematic representation of the media stack similar to that of FIG. 6, but now showing the top of the stack at the upper home operating position of the pick mechanism.

Figure 8:
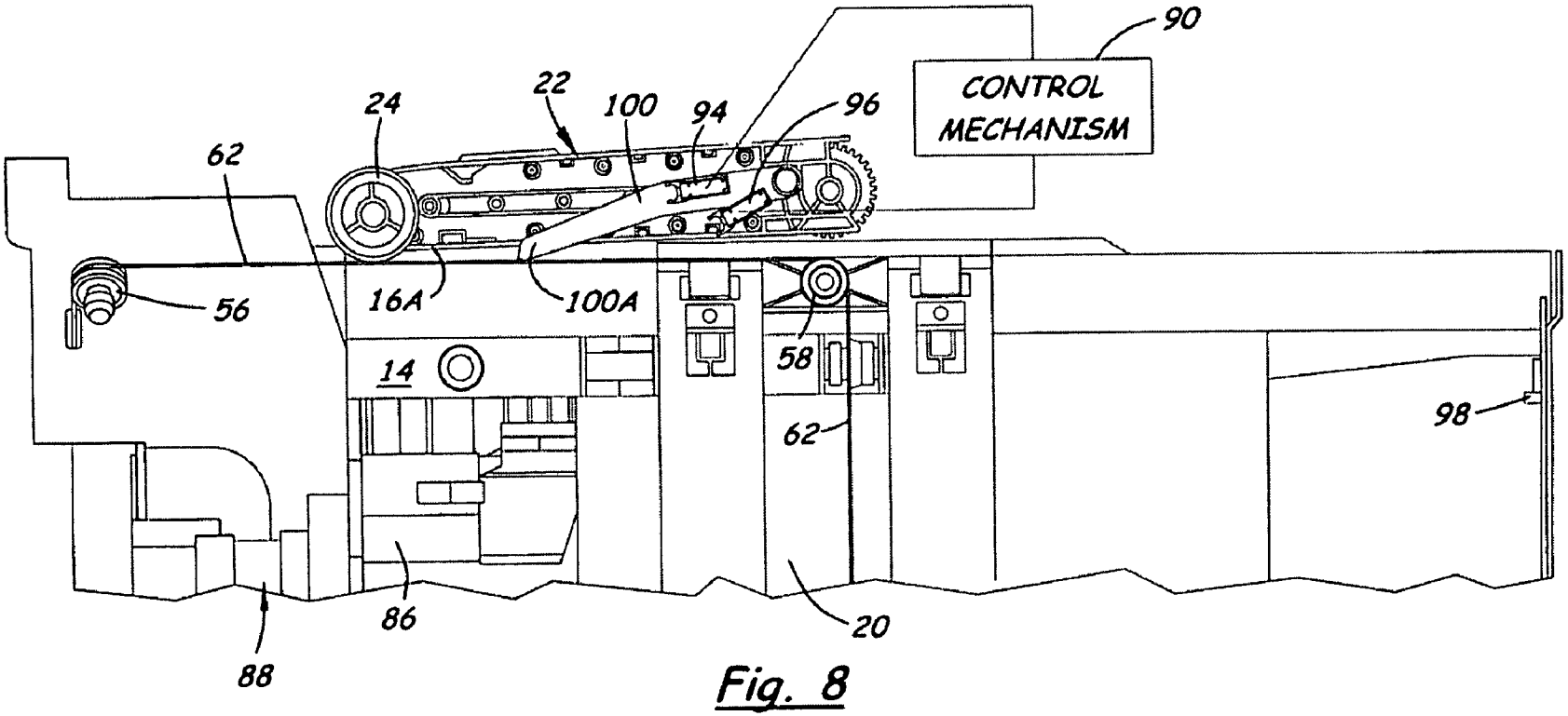

FIG. 8 is a schematic representation of the media stack similar to that of FIG. 7, but now showing the remainder of the media stack within the home and limit operating positions of the pick mechanism and the platform having reached its uppermost point of travel.

Figure 9:
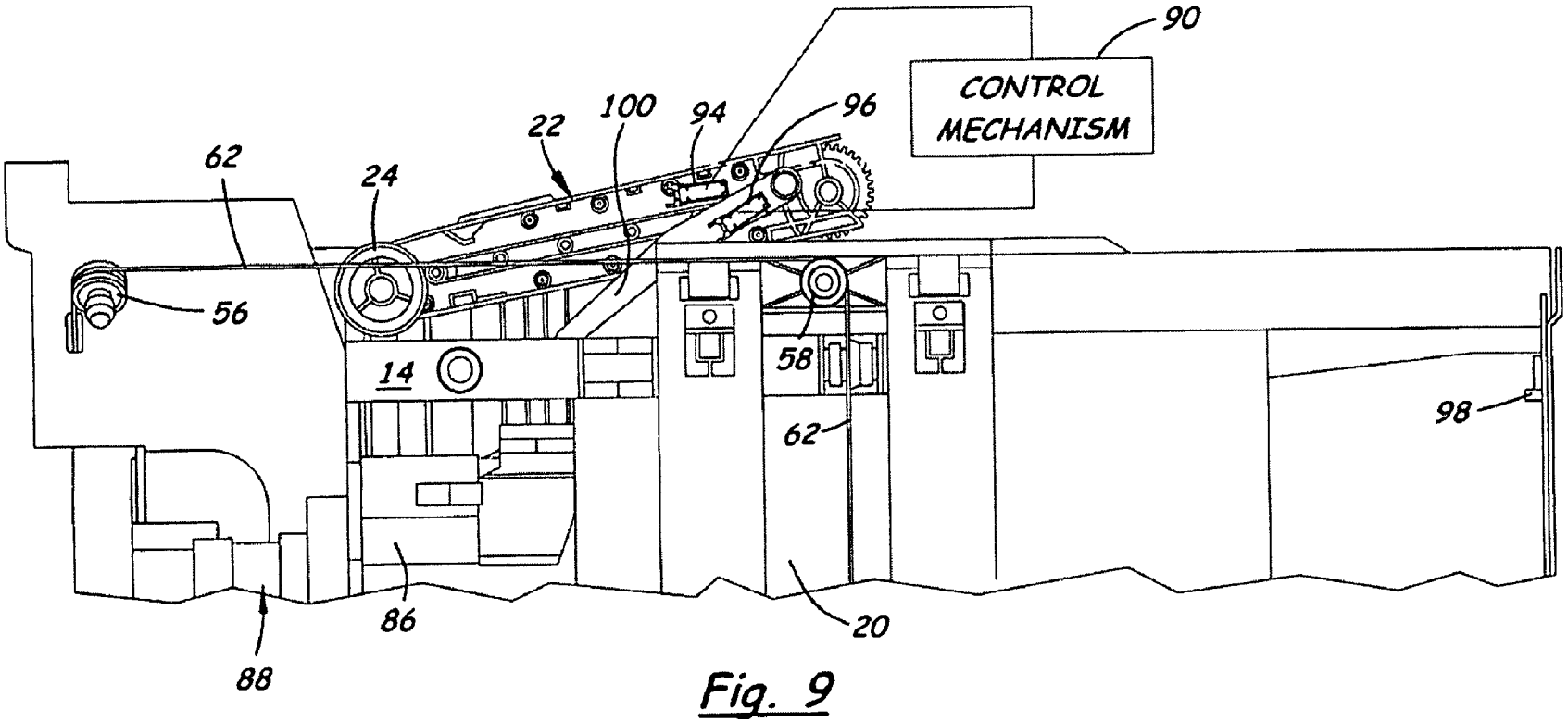

FIG. 9 is a schematic representation of the pick mechanism with its feed roll resting on the platform after having removed all sheets in the media stack from the platform.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Conversion of Movement of Bin Into Movement of Stack Platform

Referring now to FIGS. 1 and 2, there is illustrated a media handling system 10, in accordance with the invention of the cross-referenced patent application, for an image forming machine (not shown). The system 10 includes a stationary frame 12 (only fragmentary portions of which are shown in the form of drawer slides 12A and a frame member 12B), an elevator tray or platform 14 supporting a stack 16 of media sheets 18 thereon, and a drawer or bin 20 supporting the platform 14 and in turn supported on the stationary frame 12 for undergoing movement relative thereto between first and second positions, such as internal and external of the image forming machine. In moving to the first position relative to the stationary frame 12, in accordance with the invention of the cross-referenced patent application the bin 20 causes relocation or movement of the platform 14 to just below and closely adjacent to a given range of sheet feeding positions (see FIGS. 6-9) of, and in alignment with, a pick mechanism 22 of the machine which, as shown in FIGS. 6-9, can occupy those sheet feeding positions. The pick mechanism 22 has a feed roll 24 engageable with the top 16A of the media stack 16 and operable to feed media sheets 18 one at a time from the system 10 to an image forming operation of the machine when the feed roll 24 is engaged with the top 16A of the stack 16 at those positions. As will be described hereinafter, the platform 14 is movable relative to the bin 20 toward and away from the pick mechanism 22. In moving to the second position relative to the stationary frame 12 shown in FIG. 2, the bin 20 displaces the platform 14, in effect, both downwardly in the bin 20 and horizontally with the bin 20 away from and out of alignment with the sheet feeding position of the pick mechanism 22 and thus externally of the image forming machine where the platform 14 is accessible to a user to reload or replenish it with media sheets, such as seen in FIG. 4.

The media handling system 10 also includes a first motion transmitting assembly, generally designated 26, coupled between the stationary frame 12, platform 14 and bin 20 and operable to convert the movement or motion of the bin 20 between the aforementioned first and second positions relative to the stationary frame 12 into movement or motion of the platform 14 relative to the bin 20 toward and away from the sheet feeding position(s) which the feed roll 24 of the pick mechanism 22 may occupy. The first motion transmitting assembly 26 includes a spring mechanism 28, depicted in detail by itself in FIG. 3 and shown as part of the assembly 26 in FIGS. 1, 2, 4 and 5. The assembly 26 also includes a plurality of flexible members and rotatable guide elements, referred to hereinafter as a first component group 30, and a plurality of gears and shafts, referred to hereinafter as a second component group 32.

Referring now to FIGS. 1-5, generally speaking, the spring mechanism 28 is tailored to counterbalance the weight of the platform 14 and of any stack thereon in response to the position of the bin 20 relative to the stationary frame 12. In order to maintain the counterbalanced relationship, the spring mechanism 28 converts movement of the bin 20 relative to the stationary frame 12, between the first and second positions, into storing of mechanical energy within the spring mechanism 28 and also into movement of the platform 14 relative to the bin 20 toward and away from the sheet feeding position of the pick mechanism 22, in proportion to the weight of a media stack 16 on the platform 14. The lesser the weight of any stack 16 on the platform 14 the lesser the energy that is stored by the spring mechanism 28 and the greater the movement of the platform 14 and vice versa the greater the weight of the stack.

As best seen in FIG. 3, in an exemplary embodiment the spring mechanism 28 includes a hoist drum 34 defining a central axis 36 and having a first drum part 38 and a second drum part 40. The first drum part 38 has a disc portion 38A and a central hub portion 38B integrally connected to and extending axially from one side of the disc portion 38A. The second drum part 40 has a cylindrical-shaped cover portion 40A and a central hub portion 40B which is adapted to fit within a bore 38C defined in the central hub portion 38B of the first drum part 38 such that the first and second drum parts 38, 40 are disposed close together so as to define an annular cavity 42 therebetween concentric about the central axis 36. The first and second drum parts 38, 40 are so mounted to one another that they can undergo rotation relative to one another and about a shaft 44 which is mounted along the central axis 36 to and protrudes from an end 20A of the bin 20. The disc portion 38A of the first drum part 38 has an outer gear section 46 formed thereon concentric about the central axis 36. The cover portion 40A of the second drum part 40 has an outer circumferential row of gear teeth 48 formed about it outwardly of a plate section 40C of the cover portion 40A and a reel 50 integrally formed and centrally located on the outer side of the plate section 40C of the cover portion 40A on an opposite side of the hoist drum 34 from the end 20A of the bin 20.

The spring mechanism 28 also includes a spring device 52 disposed in the annular cavity 42. The spring device 52 may take the form of a spiral leaf spring having opposite ends respectively connected to the first and second drum parts 38, 40 of the hoist drum 34. Alternatively, the spring device 52 also may take the form of a scrolled flat steel plate, torsion wound circular wire or other suitable constructions that are well-known to those of ordinary skill in the art. In any event, the spring device 52 functions together with the first and second component groups 30, 32 and the outer gear section 46 and the reel 50 on the hoist drum 34 to maintain the counterbalanced relationship between the position of the bin 20 relative to the stationary frame 12 and the position and weight of the platform 14 relative to the bin 20. When the platform 14 is either empty or loaded with the stack 16 of media sheets 18, the spring device 52 through the first component group 30 lifts the platform 14 and media stack 16 thereon so that the top 16A of the stack 16 is maintained at a level just below the lower limit position (see FIGS. 6 and 7) of the feed roll 26 of the pick mechanism 24 that picks the topmost sheet 18 from the stack 16. More particularly, the spring device 52 is resiliently yieldable so as to be windable and unwindable to the varying degree that maintains a wound condition biased toward unwinding and tailored to counterbalance the weight of the platform and any stack thereon such that as the weight decreases the platform is lifted by the first motion transmitting assembly 26 toward the pick mechanism 22 so as to maintain the top 16A of the stack 16 at the position below and closely adjacent to the lower limit position.

As seen in FIGS. 1, 2 and 4-9, the first component group 30 in the first motion transmitting assembly 26 includes the plurality of rotatable guide elements in the form of sheaves or pulleys 54-58 and the plurality of flexible members in the form of cables 60, 62, such as cords, ropes, wires or the like, which taken together form flexible hoist lines of a hoist that includes the hoist drum 34. The flexible cables 60, 62 are attached at one of their ends 60A, 62A to the reel 50 of the spring mechanism 28 and extend in opposite directions therefrom between the spring mechanism 28 and opposite sides 14A, 14B of the platform 14 passing over and around the pulleys 54-58 that are rotatably mounted at various stationary locations on the exterior of the bin 20. The cables 60, 62 are adapted to transmit and release the application of lifting forces (mechanical energy of the spring mechanism 28) on the opposite sides 14A, 14B of the platform 14 from the spring mechanism 28.

The first motion transmitting assembly 26 further has a stabilizer shaft subassembly 64 mounted across an underside of the platform 14. The stabilizer shaft subassembly 64 includes shafts 66 with bearing elements 68 disposed on the opposite ends of the shafts 66 adjacent to the opposite sides 14A, 14B of the platform 14. The other ends 60B, 62B of the flexible cables 60, 62 are attached to the stabilizer shaft assembly 64 adjacent to the opposite sides 14A, 14B of the platform 14. The bin 20 has vertical channels 70 formed in the opposite sides 20B, 20C of the bin 20 adapted to receive the bearing elements 68 of the stabilizer shaft assembly 64 in the channels 70 and guide the bearing elements 68 in their movement between upper and lower ends of the channels 70 as the lifting forces are transmitted to and released at the opposite sides 14A, 14B of the platform 14.

The second component group 32 in the first motion transmitting assembly 26, the plurality of gears 72-78 and shafts 80, 82, couples the outer gear section 46 of the first drum part 38 of the hoist drum 34 with a gear rack 84 on the frame member 12B of the stationary frame 12. With such coupled arrangement, motion of the bin 20 relative to the stationary frame 12 between the first and second positions is transmitted through the aforementioned second component group 32 to the first drum part 38 of the hoist drum 34 to where the motion is converted by the spring device 52 into motion that is transmitted through the aforementioned first component group 30 to the opposite sides 14A, 14B of the platform 14.

To recap the invention of the cross-referenced patent application, the bin 20 can be moved in and out of the main body or frame 12 of the machine by its attachment to the drawer slides 12A. A stack 16 of sheets 18 is placed on the tray or platform 14 in the bin 20 which can move vertically in the bin 20 with the stabilizer shaft subassembly 64 as its guide. One ends 60A, 62A of the lifting cables 60, 62 are attached to the reel 50 of the hoist drum 34 and the other ends 60B, 62B of the lifting cables 60, 62 are attached to the opposite sides 14A, 14B of the platform 14 through the stabilizer shaft subassembly 64. The spiral spring device 52 inside the hoist drum 34 tends to rotate the drum 34 in the opposite direction of the weight of the platform 14 and stack 16 thereon or upward. Thus, in this arrangement, the platform 14 is always biased towards the top of the bin 20. The hoist drum 34 and the second component group 32, made up of the gears 72-78 and shafts 66, 68, together with the gear rack 84 can be viewed together as a spring booster assembly. Except for the gear rack 84 which is normally connected to the main body or frame 12 (via the frame member 12B) of the machine, all these other parts of the assembly 26 are mounted on the bin 20. When the bin 20 is moved in or out of the frame 12, gear 72 rotates against the stationary gear rack 84. The angular displacement of the gear 72 is transmitted to the hoist drum 34 via the intervening gears 74-78 and shafts 80, 82. For example, when the bin 20 is moved outward away from the machine, the hoist drum 34 is rotated accordingly and releases force (stored mechanical energy) against the spiral spring device 52 or causes it to unwind inside the hoist drum 34. This in turn causes (or allows) the platform 14 and any stack 16 thereon to move lower down and avoid interfering with other parts, primarily, of the pick mechanism 22. On the other hand, when the bin 20 is moved toward and into the main body or frame 12, the hoist drum 34 is rotated in the opposite direction and causes the spiral spring device 52 to wind and tighten and thereby lift the platform 14 and the stack 16 thereon until counterbalance is attained.

The force on the spiral spring device 52 is "sized", or tailored, so that the top 16A of the media stack 16 is always lifted to a level just below the elevation of the lower limit of the feed roll 24 of the pick mechanism 22 where the feed roll 24 does not engage the stack top 16A. The media handling system 10 has additional "motive power-based" components, which will be described next relative to the present invention, that function together with the above-described "spring assist lift" components of the system 10 of the invention of the cross-referenced patent application, to boost movement of the platform 14 and stack 16 the remainder of the distance upward into engagement with the feed roll 24 of the pick mechanism 22 and also be able to resist the downward force on the stack 16 by the feed roll 24 during sheet feeding operations.

Maintenance of Stack Top Within Given Range of Pick Positions

Turning now to FIGS. 4-9, there is illustrated the additional "motive power-based" components of the media handling system 10 as well as the "spring assist lift" components as previously described hereinabove. These additional components of the system 10 which constitute a second motion transmitting assembly 85 include a low torque drive motor 86, preferably electrically operated, and a gear train 88 which drivingly couples the drive motor 86 with the circumferential row of gear teeth 48 on the cover portion 40A of the second drum part 40 of the spring mechanism hoist drum 40 of the first motion transmitting assembly 26. The provision of the "spring assist lift" components to elevate the platform 14 and stack 16 through most of the vertical distance, as described hereinbefore, serves to minimize the additional distance of upward vertical travel the platform 14 has to undergo with the aid of the drive motor 86 and gear train 88 to touch the feed roll 24 of the pick mechanism 22 and, hence, minimizes the electrical energy consumption requirements of the system 10.

Thus, the present invention is directed to this additional "low power requirement" capability of the media handling system 10, due to the implementation of the drive motor 86 and gear train 88 of the second motion transmitting assembly 85 and a control mechanism 90 combined with the above-described spring assist lift components (spring mechanism 28 and first and second component groups 30, 32 of the first motion transmitting assembly 26), in maintaining the top 16A of a relatively large stack 16 of media (i.e., greater than 500 sheets) within a given range or operating window of the pick mechanism 22, as seen in FIGS. 6-9. The control mechanism 90 which will be described in detail below utilizes sensors to indicate the position and status of the media stack 16 with respect to the operating window of the media handling system 10.

As illustrated in FIGS. 4 and 5, periodically or intermittently, the drive motor 86 of the assembly 85, which is mounted to the frame 12, will be detached from the gear train 88, which is mounted to the bin 20, at a suitable point in the gear train 88. A one-way clutch 92 is interposed between the drive motor 86 and spring mechanism 28 so as to restrict the drive motor 86 to only drivingly rotate the gear train 88 is one direction, that being, the direction that causes lifting of the platform 14. The spring mechanism 28 is normally at or near rest state when no media is present on the platform 14. To load media on the platform 14, the bin 20 is slidably moved to the external position from the internal position to remove the platform 14 from the operating environment. This automatically disconnects the gear train 88 from the drive motor 86. The media handling system 10 takes advantage of the media weight by using it to energize the counterbalance spring mechanism 28 by causing the spiral leaf spring 52 to be wound tighter.

Referring to FIG. 4, media sheets (normally in reams) are shown being loaded onto the platform 14. The vertically movable platform 14 supporting the media stack 16 pulls downward on the cables 60, 62 coupled to the hoist drum 34 via the reel 50. Thus, the loading process winds the spiral leaf spring 52 tighter so that it stores mechanical energy and will be ready to use it for lifting the platform 14 and media stack 16. The loading of the media stack 16 forces the platform 14 to move down until force equilibrium is attained between the media stack 16 and the spring mechanism 28. This process is repeated until the bin 20 is filled. Then the bin 20 with the platform 14 loaded with the media stack 16 is moved from the external position back to the internal position which automatically re-couples the gear train 88 to the drive motor 86. The spiral leaf spring 52 of the spring mechanism 28 is designed so that with the lightest media type supported on the platform 14, the media stack 16 is exerting slightly more force compared to the spiral leaf spring 52. The delta between the spring energy and the media weight along with various resistances (frictional drag) in the system 10 will be the resulting load that the low power drive motor 86 will have to carry to lift the load to the operating level.

Referring to FIG. 5, the stabilized vertically movable platform 14 inside the bin 20 (not shown) is loaded with the media stack 16 and has been moved with the bin 20 back to the internal position in the system 10 where the drive motor 86 is re-coupled to the gear train 88 and the topmost sheets 18 from the media stack 16 can be fed to the image forming machine by the pick mechanism 22, as seen in FIGS. 6-9. It has been described earlier how the various components of the first motion transmitting assembly 26 supported on the bin 20, in turn, support the platform 14 on the bin 20 and control its vertical motion relative to the bin 20. The hoist drum 34 doubles as a gear due to the presence of the circumferential row of gear teeth 48 about its peripheral at which it is connected the gear train 88 leading to the lower power drive motor 86. As sheets 18 are fed from the stack 16, the stack 16 will start to lose its accumulated weight. This causes the spiral leaf spring 52 in the spring mechanism 28 to unwind from its coiled state for the mechanical system to come to equilibrium. This reaction coupled with the torque generated by the motor-driven gear train 88 is utilized by the system 10 to index the stack 16 upward to the top of the controlled operating position, or the HOME position, in FIG. 6, once the sensors of the control mechanism 90 sense that the media stack level has reached the minimum, or LIMIT position, of the operating level. This happens with the unwinding spiral leaf spring 52 assisting the drive motor 86 to wind the cables 60, 62 around the reel 50 of the hoist drum 34 thereby raising the vertically movable platform 14. This indexing process is repeated until the large stack 16 is consumed and the platform 14 of the system 10 is ready for another load of media.

Referring to FIGS. 6-9, there is also shown the functioning of the control mechanism 90 which can be a controller to control operations. Control is accomplished by the use of sensors to give feedback on the status of the media stack 16 within the bin 20. The control mechanism 90 operates with four sensors 94-98 and a flag 100. For example, the sensors 94, 96 can be in the form of photo-interrupters or other electromechanical switches. The flag 100 may be a mechanical device which affects the state of the sensors 94, 96 by having elements thereon which act as shutters which switch, via blocking and non-blocking of the sensors 94, 96 between off and on states by virtue of the pivotal position of the flag 100 in response to the media stack height. The first and second sensors 94, 96 monitor the status of the media stack 16; a third sensor 98 monitors the vertically movable platform 14; and a fourth sensor (not shown) monitors the media bin 20. When the platform 14 is loaded with media, as seen in FIG. 6, the top 16A of the full media stack 16 is always below the HOME position of the system 10. As the bin 20 is slidably installed into operational engagement, the media bin presence or fourth sensor tells the media handling system 10 that the bin 20 is in operational engagement. This signal, together with the signal from the first and second media level sensors 94, 96, from activation by the flag 100, indicate that the media level is below the HOME position, thereby triggering the drive motor 86 to turn, lifting the media stack 16. Once the media level sensors 94, 96 indicate that the media stack 16 is at HOME position, the drive motor 86 is switched off and the media handling system 10 is now ready to start feeding sheets 18 into the image forming machine or an intermediate module that feeds the sheets into the machine.

Referring now to FIG. 7, one of the drive gears near the drive motor 86 and before the point of its disengagement has the one-way clutch 92 that locks the drive motor 86 so as to allow only the upward motion of the platform 14 when the control mechanism 90 is in operational engagement. The one-way clutch 92 prevents any downward movement of the platform 14 when the feed roll 24 of the pick mechanism 22 is picking sheets. The vertically movable platform 14 is only allowed to move down when the bin 20 is removed from the internal position, the site of operational engagement, to the external position, the site for loading of media. When feeding sheets of media with the feed roll 24 of the pick mechanism 22, the vertically movable platform 14 does not move up due to the drive motor 86 being turned off, until such time the media supply within the operational feeding level is exhausted and the media level flag 100 activates the first and second media level sensors 94, 96 to indicate this condition (LIMIT position) or a set number of sheets have been picked. The drive motor 86 is turned on until the flag 100 activates the first and second media level sensors 94, 96 to indicate that the stack has reached HOME position.

Turning now to FIGS. 8 and 9, throughout the operation of the feed roll 24 of the pick mechanism 22, the media stack level is only allowed to fall within the HOME and LIMIT positions. This operating window allows for lesser wear on paper path components such as wear strips and takes advantage of the flexibility of having a pick mechanism 22 with a pivotal pick arm 102 mounting the feed roll 24 as to a fixed pick mechanism. The indexing process is repeated as deemed necessary until the whole stack of media sheets have reached the LOW state, as seen in FIG. 8. The LOW state is a condition wherein the media stack is within the HOME and LIMIT positions and the stabilized vertically movable platform 14 has reached its topmost point of motion. At this point, the third sensor 98 which monitors the vertically movable platform 14 is tripped and the drive motor 86 is prevented from further rotation. As the picking process continues to the last sheet as seen in FIG. 9, the front tip 100A of the media level flag 100 drops into a hole (not shown) in the platform 14 as soon as the trailing edge of the last sheet leaves contact with the media level flag 100. The media handling system 10 is then notified that it is empty and operation is suspended until a fresh load of media is inserted into the bin 20.

To recap, in accordance with the present invention, by utilizing the spring assist lift components to counterbalance the accumulated weight of the media stack 16 and vertically movable platform 14 on which the stack rest, the drive motor 86 with only a low torque or power rating together with the gear train 88, the one-way clutch 92 and the sensors 94-98 and flag 10 of the control mechanism 90 are sufficient to achieve the added lifting of the media stack 16 to the HOME position of the operating feed roll 24 of the pick mechanism 22. Thus, the addition of a separate power supply for the system 10 is not required. The control mechanism 90 regulates the movement of the platform 14 within the given range of the pick mechanism 22, between the LIMIT and HOME positions, in order to actively control the position of the top 16A of the media stack 16 according to the operating conditions desired. The desired operating conditions are a relatively reasonable operating window of media type and weight which may include, by way of example but not limitation, A4 to LGL sheet sizes and 20 to 32 lb sheet weights. It should be noted that the use of the type of spring device 52 as contemplated herein does not require any adjustment to support the varying media sizes and weights.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A media handling system for an image forming machine, comprising:

a stationary frame;

a platform to support a stack of media sheets; the media sheets being stacked such that a top of the stack of media sheets being stacked within a range extending from a lower limit position to an upper home position;

a sheet feeding mechanism having a feed roll engageable with the top of the stack of media sheets;

a bin disposed at least partially around and below the platform for support, the bin being movable relative to the stationary frame, wherein the platform is aligned with the sheet feeding mechanism for movement toward and away from the sheet feeding mechanism relative to the bin, a first motion transmitting assembly comprising a spring member to bias the platform and the media towards the sheet feeding mechanism thereby counterbalancing weight of the platform and the media sheets thereon, the first motion transmitting assembly being disposed between the platform and the bin;

a control mechanism disposed on the stationary frame to sense the position of the top of a stack extending from between the lower limit position to the upper home position; and a second motion transmitting assembly having a first portion disposed on the bin and a second portion disposed on the stationary frame such that first and second portions are drivingly coupled to said platform via said first motion transmitting assembly, wherein the first motion transmitting assembly further includes a spring mechanism biasing said platform and any stack thereon toward said sheet feeding mechanism so as to maintain the top of the stack at said position below and closely adjacent to said lower limit position, and wherein said first motion transmitting assembly further includes a plurality of flexible members and rotatable guide elements forming flexible lines of a hoist that extend oppositely from said spring mechanism between said spring mechanism and opposite sides of said platform for transmitting and releasing lifting forces on said opposite sides of said platform by said spring mechanism, and wherein said first motion transmitting assembly includes a stabilizer shaft subassembly mounted across an underside of said platform and having bearing elements disposed on opposite ends thereof adjacent to said opposite sides of said platform such that ends of said flexible lines are coupled to said stabilizer shaft subassembly adjacent to said opposite sides of said platform, and wherein said bin has vertical channels formed in opposite sides thereof for receiving said bearing elements of said stabilizer shaft subassembly in said channels and guide said bearing elements in moving between upper and lower ends of said channels as said lifting forces are transmitted to and released from said opposite sides of said platform, and wherein said first motion transmitting assembly further includes a plurality of gears and shafts coupling said spring mechanism with a portion of said stationary frame such that motion of said bin relative to said stationary frame between said first and second positions is transmitted through said plurality of gears and shafts to said spring mechanism to where said motion is converted and then transmitted through said plurality of flexible members and rotatable elements to said opposite sides of said platform.

2. The system of claim 1 wherein said first portion of said second motion transmitting assembly is a gear train and said second portion of said second motion transmitting assembly is a drive motor such that said drive motor is coupled to said gear train and thus drivingly connected to said spring mechanism and drive motion is transmitted through said spring mechanism and said plurality of flexible members and rotatable elements of said first motion transmitting assembly so as to apply said additional lifting forces on said opposite sides of said platform when said bin is at said first position whereas said drive motor is de-coupled from said gear train when said bin is moved to said second position.

* * * * *